US011543781B1

(12) United States Patent
Barroche

(10) Patent No.: US 11,543,781 B1
(45) Date of Patent: Jan. 3, 2023

(54) TIME TRACKING SYSTEM AND METHOD OF USE

(71) Applicant: Anahi Barroche, Pearland, TX (US)

(72) Inventor: Anahi Barroche, Pearland, TX (US)

( * ) Notice: Subject to any disclaimer, the term of this patent is extended or adjusted under 35 U.S.C. 154(b) by 476 days.

(21) Appl. No.: 16/581,944

(22) Filed: Sep. 25, 2019

(51) Int. Cl.

| | |
|---|---|
| ***G04G 17/08*** | (2006.01) |
| ***G04G 7/00*** | (2006.01) |
| ***G04G 11/00*** | (2006.01) |
| ***G04G 17/06*** | (2006.01) |

(52) U.S. Cl.
CPC ..... *G04G 17/08* (2013.01); *G04G 7/026* (2013.01); *G04G 11/00* (2013.01); *G04G 17/06* (2013.01)

(58) Field of Classification Search
CPC ..... G04G 7/026; G04G 11/00; G04G 17/06; G01B 11/026; G04F 10/00; G04F 8/08
USPC ..... 368/107, 108, 109, 89
See application file for complete search history.

(56) References Cited

U.S. PATENT DOCUMENTS

| | | | | |
|---|---|---|---|---|
| 5,136,621 | A * | 8/1992 | Mitchell | G04F 10/00 377/5 |
| 7,345,958 | B1 * | 3/2008 | Kneafsey | G04F 10/00 368/107 |
| 8,696,420 | B2 * | 4/2014 | Mueller | A63B 71/06 700/91 |
| 10,918,907 | B2 * | 2/2021 | Niehaus | G09B 19/0038 |
| 11,052,287 | B2 * | 7/2021 | Firmin | G06T 7/248 |

* cited by examiner

*Primary Examiner* — Edwin A. Leon
(74) *Attorney, Agent, or Firm* — Leavitt Eldredge Law Firm

(57) ABSTRACT

A time tracking system includes a stopwatch having a waterproof housing, the stopwatch further having a control system with a transceiver for communication; a first sensor secured to a first end of a swimming lane, the first sensor to communicate with the stopwatch via the transceiver; the control system is to track swimming speed based off of communication with the first sensor.

4 Claims, 4 Drawing Sheets

TIME TRACKING SYSTEM AND METHOD OF USE

BACKGROUND

1. Field of the Invention

The present invention relates generally to time tracking systems, and more specifically, to a time tracking system for use while swimming laps to automatically collect data related to a user's swim time.

2. Description of Related Art

Time tracking systems are well known in the art and are effective means to collect time for a user to improve a skill. For example, FIG. 1 depicts a flowchart 101 of a conventional method, wherein a user desires to track their swimming time. During use, the user will wear a stopwatch, as shown with box 103. The user will activate the stopwatch and proceed to swim, wherein the user will have to stop or otherwise interrupt their swimming to check their time, as shown with boxes 105, 107.

One of the problems commonly associated with method 101 is time tracking inefficiency. For example, when the user has to stop swimming each time, they want to observe their score, their swimming is interrupted and becomes inefficient.

Accordingly, although great strides have been made in the area of time tracking systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
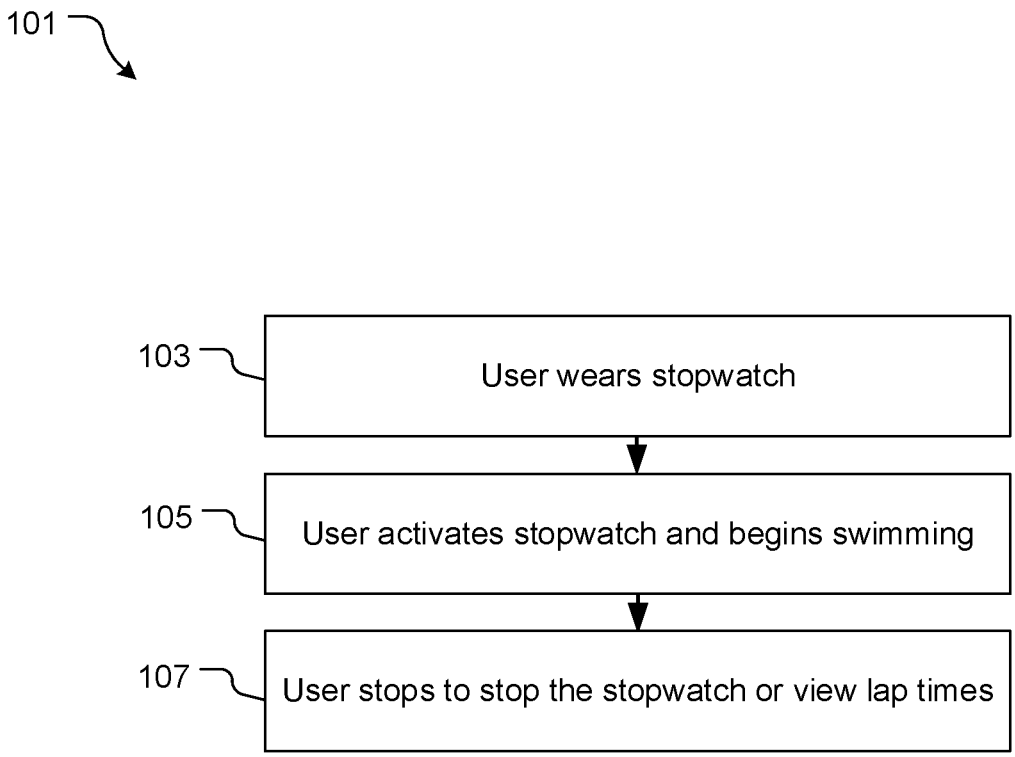
FIG. 1 (Prior Art)
FIG. 1 is a flowchart of a conventional time tracking system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional time tracking systems. Specifically, the present invention provides for an automatic time tracking system that utilizes a waterproof stop watch and one or more sensors to automatically track a user's time. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
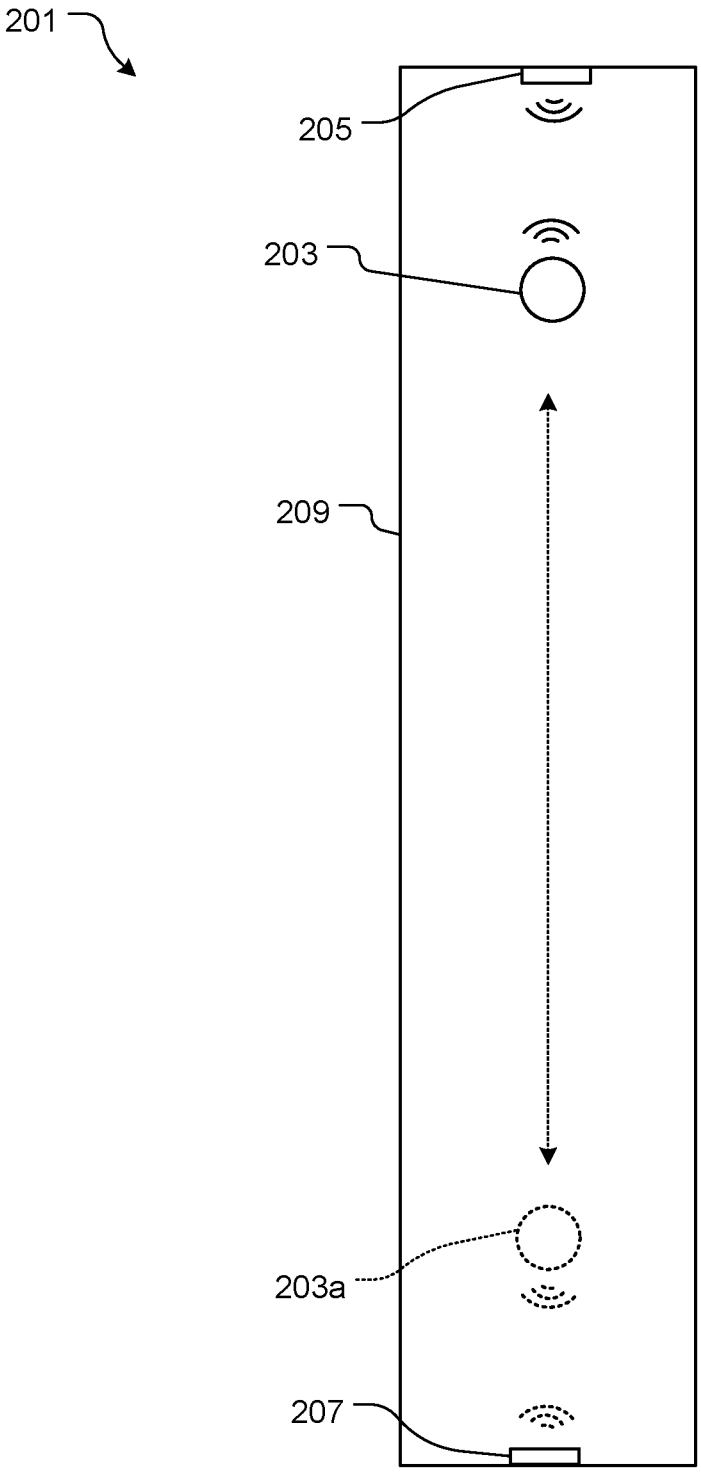
FIG. 2 is a top simplified schematic of a time tracking system in accordance with a preferred embodiment of the present application.

Referring now to the drawings wherein like reference characters identify corresponding or similar elements throughout the several views, FIG. 2 depicts a top simplified schematic of a time tracking system 201 in accordance with a preferred embodiment of the present application. It will be appreciated that system 201 overcomes one of more of the above-listed problems commonly associated with conventional time tracking systems.

In the contemplated embodiment, system 201 includes a waterproof stopwatch 203 that is worn by a user (not shown), the waterproof stopwatch configured to communicate with one or more sensors 205, 207 as a user swims laps within a swim lane 209. It should be appreciated that the user can either utilize one sensor or two based on their needs.

It should be appreciated that one of the unique features believed characteristic of the present application is the use of a waterproof stopwatch with one or more sensors. This feature allows for a user to track time without stopping.

Figure 3:
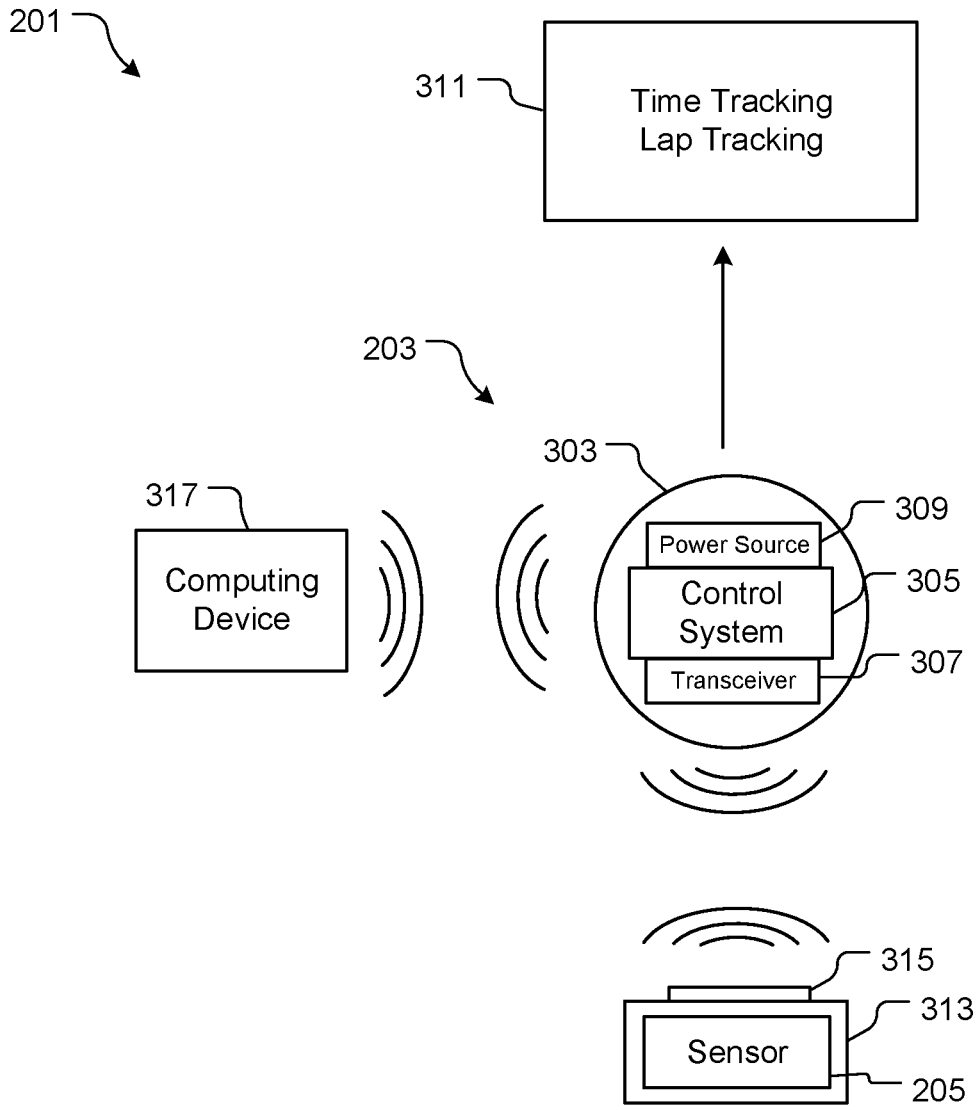
FIG. 3 is a schematic of the features of a stopwatch and a sensor of FIG. 2.

In FIG. 3, the features of system 201 are shown. As shown, the stopwatch 203 can include a waterproof housing 303 containing the necessary components, such as a control system 305, transceiver 307, and power source 309. It should be appreciated that the style of the stopwatch can vary based on aesthetical, functional, or manufacturing considerations.

In the preferred embodiment, the stopwatch 203 is configured to communicate with a sensor 205 to track time and laps 311. In the preferred embodiment, the sensor 205 is housed in a silicone housing 313 and includes a touch pad 315. During use, as the user touches the touch pad 315, the sensor 205 communicates with the stopwatch 203 to track the time of the user. It is contemplated however that alternative embodiments could include alternative means of activating the communication between the stopwatch and the sensor.

It is contemplated that in alternative embodiments, the stopwatch 303 can further be configured to communicate with a computing device 317, such as a computer, phone, or tablet, wherein the computing device 317 can include a mobile app or the like for time tracking.

Figure 4:
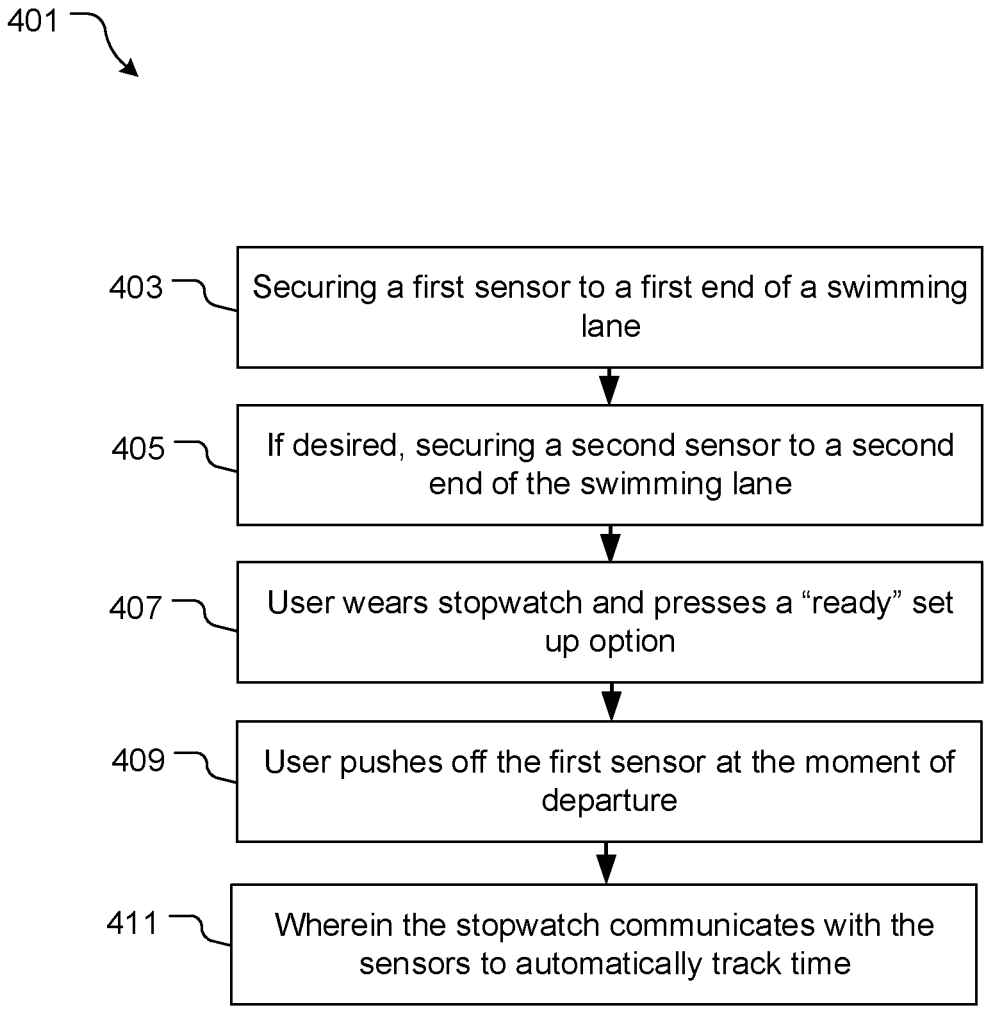
FIG. 4 is a flowchart of a method of use of the system of FIG. 2.

In FIG. 4, a flowchart 401 depicts a method of use of system 201. During use, the one or two sensors are secured to the first and second ends of a swim lane, as shown with boxes 403, 405. The user will then wear the stopwatch and press on the "ready" set up option which will get the stopwatch ready to start, as shown with box 407. Then in order to activate the stopwatch to start time tracking accurately, the swimmer will need to push off of the first sensor at the moment of departure in order to ensure that the time counter begins and it is as accurate as possible, as shown with box 409. The stopwatch will communicate with the sensors to automatically track the user's time, as shown with box 411.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A time tracking system, comprising:

a stopwatch having a waterproof housing, the stopwatch further having a control system with a transceiver for communication to a remote computing device wirelessly, the stopwatch is secure to a swimmer; and a first sensor secured to a first end of a swimming lane, the first sensor configured to communicate with the stopwatch via the transceiver, the first sensor is configured to record a time lapse as the stopwatch travels a length of the swimming lane;

wherein the control system is configured to track swimming speed based off of communication with the first sensor and the stopwatch.

2. The system of claim 1, further comprising:

a second sensor secured to a second end of the swimming lane, the second sensor configured to communicate with the stopwatch via the transceiver.

3. A method of tracking swimming time, the method comprising:

providing the system of claim 1;

securing the first sensor at the first end of the swimming lane;

activating time tracking via the stopwatch;

transmitting data to a remote computing device; and calculating swimming speed;

wherein the stopwatch communicates with the first sensor to track time.

4. The method of claim 3, further comprising:

securing a second sensor to a second end of the swimming lane; and wherein the stopwatch communicates with the first and second sensor to track time.

* * * * *